US009915151B2

(12) United States Patent
Weaver et al.

(10) Patent No.: US 9,915,151 B2
(45) Date of Patent: Mar. 13, 2018

(54) CMC AIRFOIL WITH COOLING CHANNELS

(71) Applicant: Rolls-Royce Corporation, Indianapolis, IN (US)

(72) Inventors: John Alan Weaver, Indianapolis, IN (US); Okey Kwon, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 309 days.

(21) Appl. No.: 14/721,164

(22) Filed: May 26, 2015

(65) Prior Publication Data

US 2016/0348513 A1 Dec. 1, 2016

(51) Int. Cl.

| | |
|---|---|
| ***F01D 5/28*** | (2006.01) |
| ***F01D 5/18*** | (2006.01) |
| ***F01D 9/02*** | (2006.01) |

(52) U.S. Cl.

CPC ..... *F01D 5/188* (2013.01); *F01D 5/282* (2013.01); *F01D 9/02* (2013.01); *F05D 2240/12* (2013.01); *F05D 2260/221* (2013.01); *F05D 2300/6033* (2013.01)

(58) Field of Classification Search

USPC ..... 416/96 A, 96 R, 97 R; 415/115, 200

See application file for complete search history.

(56) References Cited

U.S. PATENT DOCUMENTS 1,324,714 A * 12/1919 Allen ..... B21C 37/122 122/367.2
5,704,763 A * 1/1998 Lee ..... F01D 5/188 415/115
5,993,156 A * 11/1999 Bailly ..... F01D 5/187 415/115
6,193,465 B1 * 2/2001 Liotta ..... B23P 15/04 29/889.722
6,981,846 B2 1/2006 Liang
7,137,781 B2 * 11/2006 Harvey ..... F01D 5/187 415/115
7,452,189 B2 11/2008 Shi et al.
7,520,723 B2 4/2009 Liang (Continued)

OTHER PUBLICATIONS

Glezer, B., Moon et al., Heat Transfer in a Rotating Channel with Swirling Internal Flow, dated Jun. 2, 1998, pp. 1-8, ASME 98-GT-214, Cambridge, Massachusetts.

(Continued)

*Primary Examiner* — Woody Lee, Jr.
*Assistant Examiner* — Theodore Ribadeneyra
(74) *Attorney, Agent, or Firm* — Brinks Gilson & Lione

(57) ABSTRACT

An airfoil may be provided that includes a CMC body and a support piece. The CMC body has an inner surface that defines a chamber within the CMC body. The support piece may be positioned within the chamber of the CMC body. The support piece comprises a channel in a surface of the support piece, the surface being in contact with the inner surface of the CMC body. The channel and the inner surface of the CMC body define a passageway for a cooling fluid. The passageway may wind about the circumference of the CMC body and extend along the span of the airfoil. Outlets may be positioned through the CMC body allowing fluid communication between the passageway and the outer surface of the CMC body.

18 Claims, 4 Drawing Sheets

(56) References Cited

U.S. PATENT DOCUMENTS

| | | | | |
|---|---|---|---|---|
| 7,963,745 | B1 | 6/2011 | Liang | |
| 7,993,104 | B1 | 8/2011 | Ewing, Jr. | |
| 8,015,705 | B2 * | 9/2011 | Wilson, Jr. | F01D 5/147 29/889.3 |
| 8,047,789 | B1 * | 11/2011 | Liang | F01D 5/147 416/97 R |
| 8,142,163 | B1 | 3/2012 | Davies | |
| 8,186,953 | B1 * | 5/2012 | Kimmel | F01D 5/187 416/97 R |
| 8,197,211 | B1 | 6/2012 | Liang | |
| 8,251,660 | B1 | 8/2012 | Liang | |
| 8,596,976 | B2 * | 12/2013 | Hada | F01D 5/189 415/115 |
| 2009/0169394 | A1 * | 7/2009 | Crow | B23H 9/10 416/96 R |
| 2009/0169395 | A1 * | 7/2009 | Wilson, Jr. | F01D 5/28 416/97 R |
| 2010/0068034 | A1 * | 3/2010 | Schiavo | F01D 5/189 415/115 |
| 2014/0271153 | A1 | 9/2014 | Uskert et al. | |

OTHER PUBLICATIONS

Hwang, J.-J. et al., Augmented Heat Transfer in a Triangular Duct Using Multiple Swirling Jets, dated Aug. 1999, pp. 683-690, Journal of Heat Transfer, vol. 121, ASME, Chung-Hua University, Hsinchu, Taiwan.

* cited by examiner

CMC AIRFOIL WITH COOLING CHANNELS

TECHNICAL FIELD

This disclosure relates to cooling systems for airfoils for use in turbine engines and, in particular, to air cooling systems for airfoils that have ceramic matric composite (CMC) bodies.

BACKGROUND

The statements in this section merely provide background information related to the present disclosure and may not constitute prior art.

A CMC body may be placed over a metallic support piece to limit deformation of the CMC body when the CMC body is subjected to mechanical stress. In some examples, the CMC body may be a CMC vane or a CMC blade, which is subjected to mechanical stress such as an aerodynamic load, and which is subject to a thermal load. CMC material is vulnerable to thermal distress under excessive thermal loading. Therefore, cooling systems are desirable for CMC vanes and blades to remove excessive heat, or to distribute heat evenly across the profile of the airfoil.

SUMMARY

Further areas of applicability will become apparent from the description provided herein. It should be understood that the description and specific examples are intended for purposes of illustration only and are not intended to limit the scope of the present disclosure.

In one embodiment of the present disclosure, an airfoil is provided comprising a CMC body and a support piece. The CMC body has an inner surface that defines a chamber within the CMC body. The support piece is positioned within the chamber of the CMC body. The support piece comprises a channel in a surface of the support piece, the surface being in contact with the inner surface of the CMC body. The channel and the inner surface of the CMC body define a passageway for a cooling fluid.

In another embodiment of the present disclosure, a method is provided comprising providing a CMC body, forming a channel in a surface of a support piece, and positioning the support piece in the CMC body. The CMC body has an inner surface, and the surface of the support piece contacts the inner surface of the CMC body. The channel and the inner surface of the CMC body define a passageway.

In yet another embodiment of the present disclosure, a vane or a blade for a gas turbine engine is provided comprising a CMC shell and a support piece. The CMC shell has an inner surface that defines a chamber within the CMC shell. The support piece is positioned within the chamber of the CMC shell. The support piece comprises a channel in a surface of the support piece, the surface being in contact with the inner surface of the CMC shell. The channel and the inner surface of the CMC shell define a passageway.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

The drawings described herein are for illustration purposes only and are not intended to limit the scope of the present disclosure in any way.

DETAILED DESCRIPTION

The following description is merely exemplary in nature and is not intended to limit the present disclosure, application, or uses.

In one example, an airfoil is provided comprising a CMC body and a support piece. The CMC body has an inner surface that defines a chamber within the CMC body. The support piece is positioned within the chamber of the CMC body. The support piece comprises a channel in a surface of the support piece. The surface of the support piece is in contact with the inner surface of the CMC body at least at one point on the inner surface of the CMC body. The channel and the inner surface of the CMC body define a passageway for a cooling fluid, such as air.

One technical advantage of the systems and methods described below may be that an airfoil described below, such as a vane or blade, may be used within a turbine engine at a higher temperature than other airfoils, as a consequence of cooling fluid distributing heat more evenly along the CMC body of the airfoil. Another technical advantage of the systems and methods described below may be that an airfoil described below may be capable of releasing a cooling fluid from outlets along the outer surface of the CMC body to cool specific regions of the airfoil.

Figure 1:
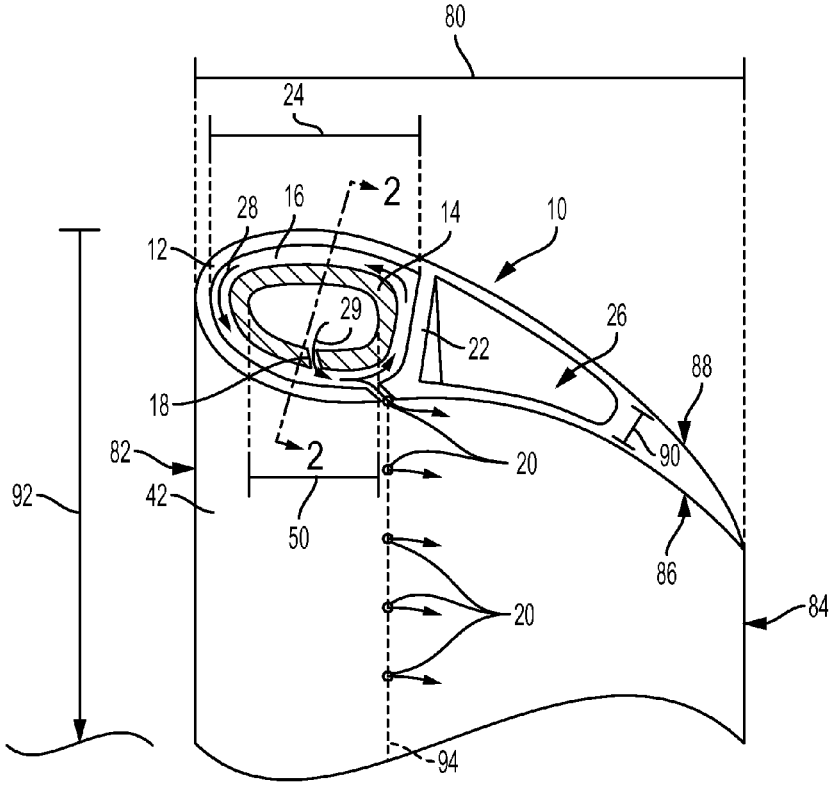
FIG. 1 illustrates a partial cross-sectional view of a first example of an airfoil comprising a CMC body and a support piece.

FIG. 1 illustrates a partial cross-sectional view of a first example of an airfoil 10 comprising a CMC body 12 and a support piece 14. The airfoil 10 may be any object which generates a pressure differential as fluid flows over the object. Examples of the airfoil 10 may include a wing, a compressor rotor, a stator, a turbine blade, and a vane. A length 80 of the airfoil 10 may be the distance between a leading edge 82 and a trailing edge 84 of the airfoil 10. Typically, the pressure differential is generated from fluid flowing from the leading edge 82 to the trailing edge 84. A thickness 90 of the airfoil 10 may be the distance between a pressure side 86 and a suction side 88 of the airfoil 10. The thickness 90 of the airfoil 10 may vary from the leading edge 82 to the trailing edge 84. A span 92 of the airfoil 10 may be a three dimensional extension of the airfoil 10 from a base (not shown) to a tip (not shown). The length 80 and thickness 90 of the airfoil may vary along the extent of the span 92.

The CMC body 12 may be any object which conforms to the shape of an outer surface 42 of the airfoil 10. The CMC body 12 may define the shape of the airfoil 10 in some examples. Examples of the CMC body 12 may include a CMC turbine blade or a hollow shell of a turbine blade or vane. The CMC body 12 may be comprised of a ceramic matrix composite material, such as a silicon carbide-silicon carbide composite.

As shown in FIG. 1, the CMC body 12 may be a hollow shell having an outer surface which is the outer surface 42 of the airfoil 10. An inner surface 34 (shown in FIG. 2) of the shell or the CMC body 12 may define at least one chamber 24, 26 within the interior of the airfoil 10. In the embodiment shown in FIG. 1, the inner surface 34 of the CMC body 12 defines a first chamber 24 and a second chamber 26. Alternatively, the inner surface 34 of the CMC body 12 may define only a single chamber or more than two chambers. The first chamber 24 and the second chamber 26 shown in FIG. 1 are separated by a strut 22, which extends between the pressure side 86 and the suction side 88 of the CMC body 12.

The strut 22 may be any structural element which passes between the pressure side 86 and the suction side 88 of the CMC body 12. Examples of the strut 22 may include a component of the CMC body, or a separate column arranged within the CMC body 12. The strut 22 may be made of the same material as the CMC body 12 or any other material.

The support piece 14 may be any component that provides support to the CMC body 12. The support piece 14 may conform, at least in part, to the inner surface 34 of the CMC body 12 and may extend along a portion of the span 92 of the airfoil 10. Examples of the support piece 14 may include a bar, a spar, or a cylinder.

The support piece 14 may be positioned within the first chamber 24 of the CMC body 12. The support piece 14 may be made of material, such as stainless steel, or non-ferrous alloys such as MAR-M-247, which provides rigidity to the CMC body 12. In some examples, the support piece 14 may be made of a material which has less thermal resistance than the CMC body 12, as the support piece 14 may encounter less thermal loading than portions of the CMC body 12. The support piece 14 may take any shape which provides support to the CMC body 12.

The support piece 14 has a surface 32 (shown in FIG. 2), which is in contact with an inner surface 34 (shown in FIG. 2) of the CMC body 12 in at least one location. A channel 15 (shown in FIG. 2) may be formed in the surface 32 of the support piece 14. The channel 15 may be any of a depression in the surface 32 of the support piece 14, which may face the inner surface 34 of the CMC body 12 when the support piece 14 is positioned in the CMC body 12. The channel 15 and the inner surface 34 of the CMC body 12 define a passageway 16 for cooling fluid, such as air, to travel between the support piece 14 and the CMC body 12. Fluid flow 28 through the passageway 16 may decrease temperature gradients across the CMC body 12.

The channel 15 may be arranged in fixed location along the extent of the span 92 of the airfoil 10. Alternatively, the channel 15 may extend along the entire extent of the span 92 of the airfoil 10. Alternatively, a passageway layer may be a cross-sectional layer extending circumferentially from the bottom of the channel 15 to the inner surface 34 of the CMC body 12. The passageway layer includes portions of the support piece 14 which are above the bottom of the channel 15. In some embodiments, the passageway 16 may comprise a majority of the cross-sectional area of the passageway layer. Further examples of the channel 15 are shown in FIGS. 3-6.

Referring back to FIG. 1, the support piece 14 may comprise or define an inlet 18 which is configured to provide cooling fluid to the passageway 16. The inlet 18 may be located at an end of the span 92 of the airfoil 10 in some embodiments. The inlet 18 may be any opening in the support piece 14 which allows air to enter the passageway 16. Examples of the inlet 18 may include a slot, a circular tube, or a span-wise channel. Alternatively or in addition, as shown in FIG. 1, an interior portion of the support piece 14 may define an interior cavity 50 which is in communication with the inlet 18. The inlet 18 may pass through the support piece 14 to provide fluid flow 29 between the interior cavity 50 and the passageway 16. Fluid pressure within the interior cavity 50 may be maintained at a higher pressure than fluid pressure in the passageway 16 to cause the fluid flow 29 from the interior cavity 50 to the passageway 16. More than one inlet 18 may be advantageous in some examples in order to ensure adequate supply of cooling fluid along the span 92 of the airfoil 10 and about the CMC body 12.

The CMC body 12 may include one or more outlets 20 configured to release cooling fluid from the passageway 16. One or more of the outlets 20 may be located at an end of the span 92 of the airfoil 10 in some embodiments. Each of the outlets 20 may be any opening which allows cooling fluid to escape from the passageway 16. Examples of the outlets 20 may include tubes or slots.

Alternatively or in addition, as shown in FIG. 1, the outlets 20 may be arrayed along the span 92 of the outer surface 42 of the CMC body 12. The outlets 20 may pass through the CMC body 12 from the passageway 16 to the outer surface 42 of the CMC body 12.

In some examples, the outlets 20 may be arranged at a common circumferential point 94 along the span 92 of the airfoil 10. Accordingly, the outlets 20 may be arranged in a line that runs along the span 92, and provide cooling to the outer surface 42 of the CMC body 12 along a portion of or the entire span 92 of the airfoil 10. The common circumferential point 94 may be any point on the outer surface 42 of the airfoil 10 where cooling or improved heat distribution is desired, such as in proximity to the leading edge 82 of the airfoil 10, the pressure side 86 of the airfoil 10, the suction side 88 of the airfoil 10, and the trailing edge 84 of the airfoil 10. The common circumferential point 94 may or may not vary along the extent of the span 92 of the airfoil 10, according to changes in the thickness 90 of the airfoil 10 and the length 80 of the airfoil.

The desired span-wise spacing of the outlets 20 may be determined by the diameter of the outlets 20. For example, making the outlets 20 have larger diameters may release more cooling fluid on the outer surface 42 of the CMC body 12, distributing heat across a larger portion of the span 92, allowing greater span-wise spacing of the outlets 20. Comparatively, making the outlets 20 have smaller diameters may release less cooling fluid on the outer surface 42 of the CMC body 12, distributing heat across a smaller portion of the span, and having smaller span-wise spacing of the outlets 20. The span-wise spacing of the outlets may vary, for example, between 0.04 inches and 0.18 inches. The ratio between the span-wise spacing of the outlets 20 and the diameter of the outlets 20 may vary, for example, between 2.5 and 6.0.

In some examples, it may be desirable to minimize the angle of the outlets 20 with respect to the outer surface 42 of the CMC body 12. A smaller angle between the outlets 20 and the outer surface 42 of the CMC body 12 may allow cooling fluid exiting the outlets 20 to remain in close proximity to the CMC body 12 and better distribute heat. However, excessively reducing the angle of the outlets 20 with respect to the CMC body 12 may compromise the thermal and structural properties of the CMC body 12. The angle of the outlets 20 with respect to the outer surface 42 of the CMC body 12 may vary, for example, between 25 degrees and 90 degrees.

Figure 2:
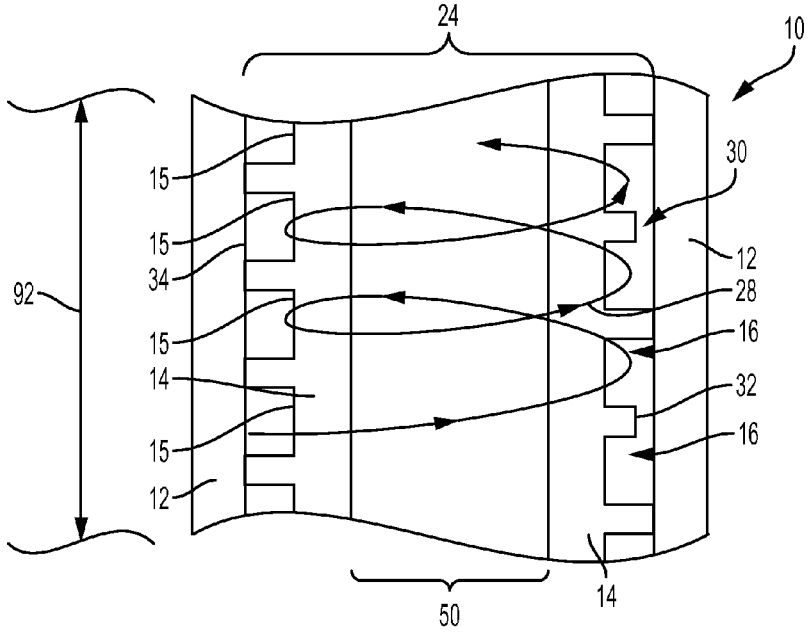
FIG. 2 illustrates a cross-sectional view of the first example of the airfoil shown in FIG. 1 comprising a CMC body and a support piece.

FIG. 2 illustrates a cross-sectional view of an embodiment of the airfoil 10 shown in FIG. 1. In FIG. 2, the CMC body 12 is shown surrounding the support piece 14. The surface 32 of the support piece 14 is in contact with at least a portion of the inner surface 34 of the CMC body 12. A gap 30 may occur between the surface 32 of the support piece 14 and the inner surface 34 of the CMC body 12. It may be advantageous in some examples to minimize the gap 30 between the surface 32 of the support piece 14 and the inner surface of the CMC body 12 to minimize the amount of fluid flow 28 which escapes from the passageway 16, to limit fluid communication between different portions of the passageway 16, or to limit fluid communication between two passageways that each carry fluid.

The channel 15 shown in FIG. 2 may be formed as a depression in the surface 34 of the support piece 14, defining a passageway 16 between the channel 15 and the inner surface 34 of the CMC body 12. The support piece 14 may be positioned within the chamber 24 defined by the CMC body 12. The support piece 14 may also surround an interior cavity 50. The channel's 15 position on the circumference of the support piece 14 may vary along the extent of the span 92 of the airfoil 10.

The passageway 16 may wind around the support piece 14 in a corkscrew pattern, as shown by the direction of fluid flow 28 in the passageway 16 in FIG. 2. The corkscrew pattern of the passageway 16 may wind about the circumference of the chamber 24. The passageway 16 may flow around the airfoil 10 and along the span 92 of the airfoil 10 forming a helical shape. The span-wise variance of the passageway 16 on each circumferential pass may be determined by a pitch in the corkscrew pattern. The pitch of the corkscrew pattern may be consistent along the span 92 of the airfoil 10 or may vary as the passageway 16 extends along the span 92 of the airfoil 10.

Figure 3:
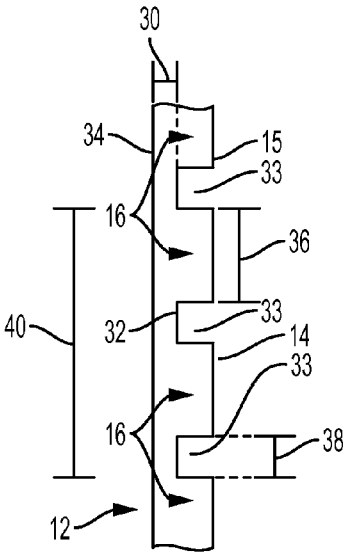
FIG. 3 illustrates a cross-sectional view of a first example of an airfoil comprising a CMC body and a support piece.

FIG. 3 illustrates a cross-sectional view of the support piece 14 and the CMC body 12 and a portion of the passageway 16, which is arranged in a corkscrew pattern. In FIG. 3, a portion of the CMC body 12 is shown opposed to a portion of the support piece 14. As with FIGS. 1 and 2, the inner surface 34 of the CMC body 12 and the surface 32 of the support piece 14 form a channel 15. Specifically, the channel 15 in the support piece and the inner surface 34 of the CMC body 12 define a passageway 16 which extends in a corkscrew pattern along the span 92 of the airfoil 10. The thickness of the CMC body 12 may vary along the length 80 of the airfoil 10, but may typically be between 0.1 inches to 0.3 inches thick. Similarly, the thickness of the support piece 14 may also vary along the length 80 of the airfoil 10, but may typically vary between 0.08 inches and 0.20 inches thick.

The characteristics of the passageway 16 arranged in the corkscrew pattern shown in FIG. 3 may vary substantially. However, in embodiments similar to that shown in FIG. 3, a width 36 of the channel 15 typically may vary between 0.03 inches and 0.06 inches. A raised portion 33 of the support piece 14 which contacts, or nearly contacts, the CMC body 12 and separates the passageway 16 from span-wise offset passes of the passageway 16 may vary in width, but typically the width 38 of the raised portion 33 of the support piece 14 may be between 0.01 inches to 0.03 inches. The gap 30 between the surface 32 of the support piece 14 at the raised portion 33 and the inner surface 34 of the CMC body may typically not exceed 0.003 inches, with typical tolerances being less than 0.002 inches. The channel 15 has a depth typically between 0.02 inches and 0.04 inches. The dimensions of the channel 15 may be substantially constant throughout the span 92 of the airfoil 10, or the dimensions may change according to the position along the span 92 of the airfoil 10.

The pitch of the corkscrew pattern of the passageway 16 may be determined at least in part by a pitch of the passageway 16, which may be the span-wise distance 40 along two consecutive circumferential passes of the channel 15 and the raised portions 33 of the support piece 14. Typically, the pitch or the span-wise distance 40 of the two consecutive circumferential passes of the channels 15 and the corresponding two raised portions 33 of the support piece 14 together may be between 0.08 inches to 0.18 inches.

The pitch of the passageway 16 may correspond to the span-wise spacing of the outlets 20 on the outer surface 42 of the CMC body 12. It may be desirable that the pitch of the passageway 16 be arranged so that the passageway 16 passes the common circumferential point 94 on the CMC body 12 to achieve a desired spacing between the outlets 20, where the outlets 20 are arranged along the common circumferential point 94 along the span 92 of the airfoil 10.

Figure 4:
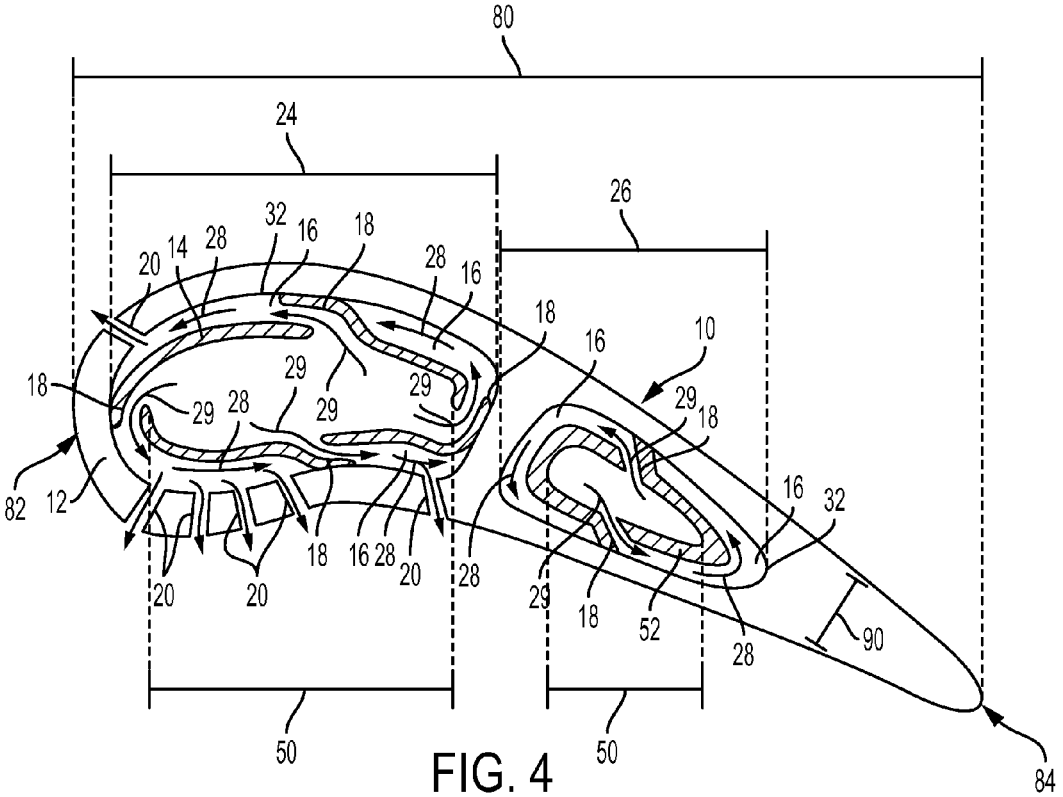
FIG. 4 illustrates a cross-sectional view of a second example of an airfoil comprising a CMC body and first and second support pieces.

Referring to FIG. 4, a cross-sectional view of another embodiment of the airfoil 10 is illustrated. In the embodiment shown in FIG. 4, multiple passageways 16 may be defined by multiple channels 15 in the surface 32 of the support piece 14 and by the inner surface 34 of the CMC body 12.

The airfoil 10 shown in FIG. 4 comprises four passageways 16 arranged about the circumference of the support piece 14. Each of the four separate passageways 16 may be used to provide cooling to a specific circumferential portion of the CMC body 12.

In some examples, the passageways 16 may be arranged in corkscrew patterns, forming a quadruple helix. In other words, each of the passageways 16 may run circumferentially around the support piece 16 in a corkscrew pattern, but not intersect with one another. In examples where the passageways 16 are arranged in corkscrew patterns, increasing the number of the passageways 16 may allow the pitch of each of the passageways 16 be increased while still providing comparable cooling to an embodiment having only one passageway. This may be advantageous in some examples because an increased pitch may allow the cooling fluid to be effective in distributing heat for a longer distance along the span 92 of the airfoil 10. Although four passageways are shown in FIG. 4, the support piece 14 may have fewer or additional passageways than are illustrated in FIG. 4. Alternatively, the passageways 16 may be arranged in any shape other than a corkscrew pattern. For example, the inlets 18 may be arranged span-wise across the support piece 14, each inlet providing cooling fluid to the passageway 16 which makes only one circumferential loop or less than a full circumferential loop.

The inlet 18 for each of the passageways 16 may be in communication with the interior cavity 50 of the support piece 14. In some embodiments, pressure in the interior cavity 50 causes the fluid flow 29 from the interior cavity 50 through the inlets 18 and into the passageways 16. The inlets 18 in the embodiment shown comprise a substantially tangential connection into the passageway 16 with respect to the surface 32 of the support piece 14. In other words, a connection portion of each of the inlets 18 that opens into a corresponding one of the passageways 16 may be substantially in parallel with the direction of fluid flow 28 in the passageway 16. Typically, the substantially tangential connection may be between 0 degrees and 20 degrees of the direction of fluid flow 28 within the passageway 16. The substantially tangential inlets 18 may allow the fluid flow 29 into the passageways 16 without the fluid impinging on the inner surface 34 of the CMC body 12 at the inlets 18. Preventing or limiting the fluid flow 29 from impinging the inner surface 34 of the CMC body 12 at the inlets 18 may reduce the local thermal gradient in the CMC body 12 and increase durability of the CMC body 12.

The CMC body 12 shown in FIG. 4 comprises the outlets 20 configured to provide communication between the passageways 16 and the outer surface 42 of the CMC body 12. The outlets 20 may be placed anywhere about the circumference of the CMC body 12 where direct cooling of the outer surface 42 is desirable including, for example, the leading and trailing edges 82, 84, as well as the pressure side 86 of the airfoil 10 and the suction side 88 of the airfoil 10. The fluid flow 28 from these outlets 20 will typically proceed in a trailing direction from the outlets 20, cooling and distributing heat along the outer surface 42 between the outlet 20 and the trailing edge of the airfoil 10. The outlets 20 may have a smaller diameter than the inlets 18 to allow a single passageway 16 having a single inlet 18 to provide fluid to multiple outlets 20. However, where the passageway 16 has only a single outlet 20 or where the passageway 16 has multiple inlets 18, the diameters of the inlets 18 and outlets 20 may be comparable. Typical outlet diameters are between 0.015 inches and 0.03 inches. Typical inlet 18 diameters are between 0.015 inches and 0.03 inches.

The embodiment of the airfoil 10 in FIG. 4 further comprises a second support piece 52 positioned in the second chamber 26 of the CMC body 12. This second support piece 52 is offset from the first support piece 14 along the length 80 of the airfoil so as to be positioned on an opposing side of the strut 22 from the first support piece 14. The second support piece 52 may fulfill a comparable function as the first support piece 14, providing structural support to the CMC body 12. Additionally, the second support piece 52 also has at least one channel 15 in the surface 32 of the second support piece 52, defining one or more of the passageways 16 between the channel 15 of the second support piece 52 and the inner surface 34 of the CMC body 12. The second support piece 52 may have a different shape than the first support piece 14. As the airfoil 10 thins towards the trailing edge 84, so may the shape of the second support piece 52, becoming thinner and proportionally longer than the first support piece 14. The embodiment of the second support piece 52 shown in FIG. 4 includes two of the passageways 16, each having a corresponding one of the inlets 18 providing fluid communication from the interior cavity 50 into each of the passageways 16.

Figure 5:
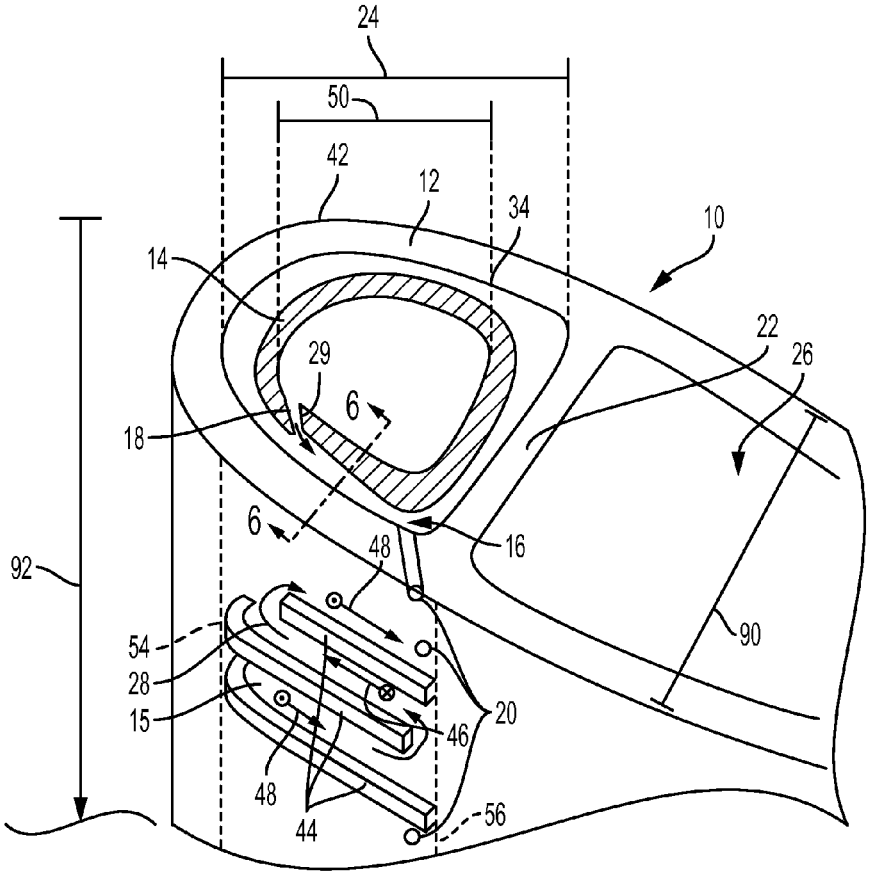
FIG. 5 illustrates an partial cross-sectional view of a third example of an airfoil comprising a CMC body and a support piece.
Figure 6:
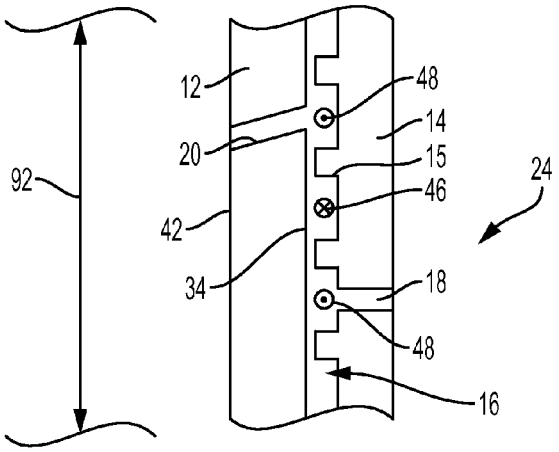
FIG. 6 illustrates a cross-sectional view of the third example of the airfoil shown in FIG. 5 comprising a CMC body and a support piece.

Referring to FIGS. 5 and 6, a partial cross-sectional view of an embodiment of the airfoil 10 is shown. The airfoil 10 in this embodiment comprises the CMC body 12 in contact with the support piece 14. The support piece 14 has the channel 15 formed in the surface 32 of the support piece 14 where the channel 15 and the inner surface 34 of the CMC body 12 define the passageway 16 for cooling fluid. The passageway 16 in FIG. 5 comprises a serpentine pattern, proceeding in one length-wise direction 46 along the circumference of the airfoil 10 before doubling back and proceeding in the opposite length-wise direction 48. This pattern of turns of the passageway 16 continues, extending along the span 92 of the airfoil 10. This pattern for the passageway 16 may be advantageous, for example, where heat transfer is desired for only a small circumferential section of the CMC body 12. The serpentine passageway 16 may be arranged to pass over a targeted area of the CMC body 12.

The serpentine passageway 16 may be formed between the leading end 54 of a portion of the support piece 14 and a trailing end 56 of the portion of the support piece 14. The position of the leading end 54 and trailing end 56 may remain consistent along the entire span 92 of the airfoil 10, or may vary as the thermal loading of the CMC body 12 changes along the span 92 of the airfoil 10. Between the leading end 54 and the trailing end 56, a series of alternating raised members 44 are positioned offset from one another along the span 92 of the airfoil 10. The raised members 44 are sufficiently raised as to contact the inner surface of the CMC body 12, and alternatingly extend along the circumference of the support piece 14 from one of the leading end 54 or the trailing end 56. The channel 15 of the serpentine passageway 16 may be formed between these raised members 44. Where the raised members 44 extend from the leading end 54, a trailing bend may be formed in the passageway 16. Where the raised members 44 extend from the trailing end 56, a leading bend may be formed in the passageway 16. Outlets 20 may be positioned in either of the leading bends or trailing bends to bleed cooling fluid to the outer surface 42 of the CMC body 12.

Turbulators (not shown) may be placed within the channel 15 to promote mixing of the fluid flow 28 within the serpentine passageways 16 and increase the channel heat transfer. The turbulators may take the form of bumps or ridges extending into the passageway 16 from the base of the channel 15.

Figure 7:
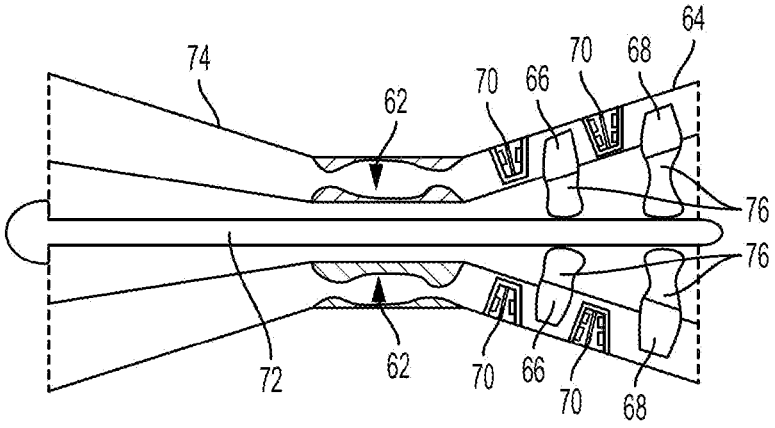
FIG. 7 illustrates a cross-sectional view of an example of a gas turbine engine, including a combustion chamber, a turbine, turbine blades, and vanes.

The embodiments of the airfoil 10 illustrated in FIGS. 1-6 and described above may be advantageous in some turbine engines. Referring to FIG. 7, an embodiment of a gas turbine engine 60 is illustrated. The gas turbine engine 60 may comprise a compressor 74, a combustion chamber 62 with a turbine 64 arranged behind the combustion chamber 62. Within the turbine 64, at least two rows of turbine blades 66, 68 extend radially from a central shaft 72 into a turbine flow path and are attached to wheels 76 that are in turn connected to the central shaft 72. Vanes 70 may be located between the two rows of turbine blades 66, 68 and/or in front of the turbine blades 66, 68 toward the combustion chamber 62 of the gas turbine engine 60. The vanes 70 may extend radially inward into the turbine flow path, or may project radially outward from a central hub which encircles the central shaft 72. As hot gas proceeds from the combustion chamber 62 into the turbine 64, the hot gas may rotate the first row of turbine blades 66. After passing through the first row of turbine blades 66, the hot gas may pass through the plurality of stationary vanes 70, which smooth the flow of the hot gas through the turbine 64 and direct the flow of the gas perpendicular to the second row of the turbine blades 68. When the gas passes through each of the turbine blades 66, 68 and the vanes 70, significant thermal loading may occur. The embodiments of the airfoil 10 described above may be used for the vanes 70 and/or the turbine blades 66, 68 in order to cool the vanes 70 and/or the turbine blades 66, 68 and to reduce thermal gradients that may develop from thermal loading.

Furthermore, although specific components are described above, methods, systems, and articles of manufacture described herein may include additional, fewer, or different components. For example, the turbine engine 60 may not include a compressor 74.

Figure 8:
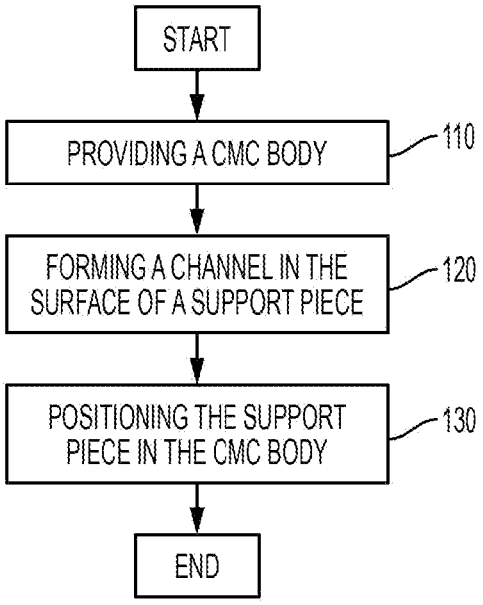
FIG. 8 illustrates a flow diagram of operations to create the passageway for fluid in the airfoil.

FIG. 8 illustrates a flow diagram of operations to create the passageway 16 for fluid in the airfoil 10. The operations may include fewer, additional, or different operations than illustrated in FIG. 8. Alternatively or in addition, the operations may be performed in a different order than illustrated.

The CMC body 12 may be provided (110), where the CMC body 12 has the inner surface 34. For example, the CMC body 12 may be manufactured.

The channel 15 may be formed (120) in the surface 32 of the support piece 14. For example, the channel 15 may be machined into the surface 32 of the support piece 14. Alternatively or in addition, the channel 15 may be chemically etched into the surface 32 of the support piece 14. In yet another example, the channel 15 may formed from a mold in which the support piece 14 is formed. In yet another example, the channel 15 is formed as the support piece 14 is printed by a three-dimensional printer.

The support piece 14 may be positioned (130) in the CMC body 12 such that the surface 32 of the support piece 14 contacts the inner surface 34 of the CMC body 12. For example, the support piece 14 may be inserted into the CMC body 12. In another example of the support piece 14 being positioned (130) in the CMC body 12, the CMC body 12 may be formed around the support piece 14. Once the support piece 14 is positioned into the CMC body 12, the channel 15 and the inner surface of the CMC body may define the passageway 16.

In addition to the advantages that have been described, it is also possible that there are still other advantages that are not currently recognized but which may become apparent at a later time. While various embodiments have been described, it will be apparent to those of ordinary skill in the art that many more embodiments and implementations are possible. Accordingly, the embodiments described herein are examples, not the only possible embodiments and implementations.

What is claimed is:

1. An airfoil comprising:

a ceramic matrix composite (CMC) body having an inner surface and a strut that define a leading edge chamber and a second chamber within the CMC body, the leading edge chamber and the second chamber separated by the strut; and a support piece positioned in the leading edge chamber of the CMC body, the support piece including an interior cavity, wherein the support piece comprises a channel in a surface of the support piece, wherein the surface of the support piece is in contact with the inner surface of the CMC body, wherein the channel and the inner surface of the CMC body define a passageway for a cooling fluid, wherein the passageway includes a first section and a second section, wherein the first section of the passageway is configured to guide the cooling fluid in a first direction along a circumference of the support piece and the second section of the passageway is configured to guide the cooling fluid in a second direction that is substantially opposite of the first direction, wherein the second direction is also along the circumference of the support piece, and wherein the support piece includes an inlet configured to provide the cooling fluid to the passageway, and the inlet is in communication with the interior cavity included in the support piece.

2. The airfoil of claim 1, wherein the passageway winds around the support piece in a corkscrew pattern.

3. The airfoil of claim 2, wherein the corkscrew pattern of the passageway extends along a span of the support piece.

4. The airfoil of claim 3, further comprising a plurality of outlets in the passageway, wherein each of the plurality of outlets is positioned at a common circumferential point along the span of the airfoil.

5. The airfoil of claim 4, wherein each of the plurality of outlets has an outlet diameter, wherein each of the plurality of outlets is separated from one another by a span-wise spacing, and wherein the ratio between the span-wise spacing of the plurality of outlets and the outlet diameter is greater than 2.50.

6. The airfoil of claim 1, wherein the passageway further comprises an outlet configured to release the cooling fluid from the passageway, and the outlet passes through the CMC body.

7. The airfoil of claim 1, wherein the passageway further comprises an outlet configured to release the cooling fluid from the passageway, and the outlet is arranged at an end of a span of the support piece.

8. The airfoil of claim 1, wherein the inlet further comprises a substantially tangential connection into the passageway.

9. The airfoil of claim 1, wherein the passageway is arranged circumferentially about a portion the surface of the support piece and extends in a serpentine pattern along a span of the airfoil.

10. The airfoil of claim 9, wherein the serpentine pattern is defined by a plurality of leading bends and a plurality of trailing bends.

11. The airfoil of claim 10, wherein the passageway comprises a plurality of outlets, wherein each of the plurality of outlets is at each of either the plurality of leading bends or the plurality of trailing bends.

12. The airfoil of claim 1, further comprising a second support piece positioned in the chamber of the CMC body, wherein a surface of the second support piece is in contact with the inner surface of the CMC body, and wherein the second support piece is offset from the support piece along a length of the airfoil.

13. The airfoil of claim 12, wherein the second support piece comprises a second channel in the surface of the second support piece, and wherein the second channel and the inner surface of the CMC body define a second passageway for the cooling fluid.

14. The airfoil of claim 12, wherein the CMC body comprises a rib positioned between the support piece and the second support piece.

15. The airfoil of claim 1, wherein the inner surface of the CMC body and the surface of the support piece are in contact so that no gap of greater than 0.003 inches exists between the inner surface of the CMC body and the surface of the support piece.

16. A method comprising:

providing a ceramic matrix composite (CMC) body having an inner surface and a strut that define a leading edge chamber and a second chamber within the CMC body, the leading edge chamber and the second chamber separated by the strut;

forming a channel in a surface of a support piece, the support piece including an interior cavity; and positioning the support piece in the leading edge chamber of the CMC body, wherein the surface of the support piece contacts the inner surface of the CMC body, wherein the channel and the inner surface of the CMC body define a passageway, the passageway includes a first section and a second section arranged circumferentially along the support piece, the first section of the passageway is configured to guide cooling fluid in a first direction circumferentially along the support piece and the second section of the passageway is configured to guide the cooling fluid circumferentially along the support piece in a second direction that is opposite of the first direction, and wherein the support piece includes an inlet configured to provide the cooling fluid to the passageway, and the inlet is in communication with the interior cavity included in the support piece.

17. The method of claim 16, further comprising providing a cooling fluid into the passageway from an interior cavity in fluid communication with the passageway through an inlet, wherein a fluid pressure in the interior cavity is higher than a fluid pressure in the passageway.

18. A vane or a blade for a gas turbine engine, the vane or the blade comprising:

a ceramic matrix composite (CMC) shell having an inner surface that defines a chamber within the CMC shell; and a strut positioned in the chamber of the CMC shell, the strut defining an interior cavity of the strut, wherein the strut comprises a channel in a surface of the strut, wherein the surface of the strut is in contact with the inner surface of the CMC shell, and wherein the channel and the inner surface of the CMC shell define a passageway, wherein the passageway winds around the strut in a corkscrew pattern and includes a first section and a second section, wherein the first section of the passageway is configured to guide a cooling fluid in a first cordwise direction along an outer surface of the strut and the second section of the passageway is configured to guide the cooling fluid in a second cordwise direction different than the first cordwise direction, wherein the second cordwise direction is also along the outer surface of the strut, and wherein the strut includes an inlet configured to provide the cooling fluid to the passageway from the interior cavity defined by the strut.

* * * * *